US007037165B2

(12) United States Patent
Garr

(10) Patent No.: US 7,037,165 B2
(45) Date of Patent: May 2, 2006

(54) CONTAINER FOR HOLDING COMPONENT PARTS OF A CONSTRUCTION TOY

(75) Inventor: Anthony R. Garr, Voorhees, NJ (US)

(73) Assignee: Connector Set Limited Partnership, Hatfield, PA (US)

( * ) Notice: Subject to any disclaimer, the term of this patent is extended or adjusted under 35 U.S.C. 154(b) by 213 days.

(21) Appl. No.: 10/766,653

(22) Filed: Jan. 27, 2004

(65) Prior Publication Data

US 2005/0164594 A1 Jul. 28, 2005

(51) Int. Cl.
*A63H 33/04* (2006.01)

(52) U.S. Cl. ..... 446/75; 446/76; 434/429

(58) Field of Classification Search ..... 446/71, 446/73, 75, 76; 434/429; 312/326–328; 294/55; 206/216, 751, 752, 759, 45.28; 220/836
See application file for complete search history.

(56) References Cited

U.S. PATENT DOCUMENTS 454,265 A * 6/1891 Fezandie ..... 312/185
607,198 A * 7/1898 Symonds ..... 312/270.2
1,246,203 A * 11/1917 Willman ..... 312/29
1,948,738 A * 2/1934 Thayer ..... 312/234
2,594,123 A * 4/1952 Cater ..... 108/36
2,685,882 A * 8/1954 Martin ..... 206/750
2,729,905 A * 1/1956 LeRoy ..... 108/63
2,983,367 A * 5/1961 Paramater et al. ..... 312/328
3,029,855 A * 4/1962 Telford ..... 206/315.91
3,232,397 A * 2/1966 McCoy ..... 190/110
3,245,574 A * 4/1966 Heinrich et al. ..... 312/8.15
3,271,092 A * 9/1966 Hatfield et al. ..... 312/311
3,326,337 A * 6/1967 Bell ..... 190/11
3,414,987 A * 12/1968 Lindenauer ..... 434/429
3,441,112 A * 4/1969 Maben ..... 190/11
3,451,580 A * 6/1969 Husby ..... 220/4.21
3,512,620 A * 5/1970 Bell et al. ..... 190/11
3,861,556 A 1/1975 Barecki et al.
4,030,235 A 6/1977 Terzian et al.
4,118,086 A * 10/1978 Kneier ..... 312/311
4,238,063 A * 12/1980 O'Dair ..... 206/315.1
4,478,005 A * 10/1984 Mundschenk ..... 49/388
4,736,837 A * 4/1988 Brainard ..... 206/749
4,836,783 A * 6/1989 Harper ..... 434/87
4,890,704 A * 1/1990 Harris ..... 190/11
5,054,783 A * 10/1991 Hull et al. ..... 273/148 A (Continued)

FOREIGN PATENT DOCUMENTS

WO WO 91/042924 4/1991

*Primary Examiner*—Bena Miller
(74) *Attorney, Agent, or Firm*—Schweitzer Cornman Gross & Bondell LLP

(57) ABSTRACT

A container for holding component parts of a construction toy. The container preferably is a suitcase or briefcase configuration, with a carrying handle at the top. An access cover, comprising a large portion of the front wall of the container and a portion of the bottom wall, is hinged on the bottom wall. When the access cover is open, both the cover and the container lie flat on a floor or other support surface, forming an extra large access opening and allowing easy access to parts within the container. The access cover, when open, forms a tray or receptacle, and can function somewhat like a dust pan, facilitating cleanup after use by enabling loose parts to be scooped onto the open cover and then discharged into the container by upward pivoting movement of the cover.

10 Claims, 5 Drawing Sheets

U.S. PATENT DOCUMENTS

| | | | | |
|---|---|---|---|---|
| D324,964 | S | 3/1992 | Ryaa | |
| D334,602 | S | 4/1993 | Ryaa | |
| 5,427,530 | A * | 6/1995 | Taggart | 434/276 |
| 5,755,499 | A * | 5/1998 | Hillesland | 312/272.5 |
| 5,788,350 | A | 8/1998 | Fladung | |
| 6,146,238 | A | 11/2000 | Daiber | |
| 6,471,060 | B1 | 10/2002 | Leyshon | |
| 2003/0085138 | A1 | 5/2003 | DeVolpi | |

* cited by examiner

CONTAINER FOR HOLDING COMPONENT PARTS OF A CONSTRUCTION TOY

BACKGROUND OF THE INVENTION

Construction toys, involving numerous individual component parts that can be joined in various ways to form structures, are popular toys with young children. One such construction toy is the K'NEX construction toy product, manufactured and marketed by K'NEX Industries, Inc., Hatfield, Pa. The K'NEX construction toy set, for example, comprises numerous plastic rods of various lengths and a wide variety of connector elements that can be joined in various ways with the rods by a lateral snap-in action. Typically, such construction sets also come with special components such as wheels, gears, motors, etc.

Construction toys are designed to enable various devices and structures to be assembled and later disassembled for building of other devices, etc. to provide continuing enjoyment over a period of time. Accordingly, it is common to provide such construction toy sets with suitably rugged containers, in which the individual component parts may be conveniently stored between play sessions using the toy. One advantageous form of such container is configured in the nature of a small suitcase or briefcase, with a convenient carrying handle at the top. Access to the container is provided through a large hinged panel, forming part of a front wall of the container, which can be opened when the container is placed in a horizontal orientation, supported by its back wall.

SUMMARY OF THE INVENTION

The present invention relates to an improvement in the above described style of container for construction toys, in which the container and its access cover are modified in a unique and advantageous manner such that, when the access cover is open, it not only provides the usual access to the contents of the container, but also provides a convenient utility for simplifying and expediting the picking up of parts after a play session is over. In this respect, the open access cover is configured somewhat in the nature of a dust pan, which extends from the bottom of the horizontally oriented open container. Loose component parts can be easily swept by hand onto the surface of the open cover and collected. When the cover is full, the parts can be discharged into the container by pivoting the cover upwardly. In addition, the horizontally oriented container may be gripped by the handle and moved in a manner to facilitate the gathering of loose components.

In a preferred embodiment of the invention, the container is configured in a novel manner, such that the access cover is comprised of a substantial portion of the front wall of the container, and also a substantial portion of the bottom wall, extending approximately half-way across the bottom wall, to form an access cover having a generally L-shaped cross sectional configuration. The access cover is pivoted to the container at approximately the mid point of the bottom wall. The geometry of the bottom wall is such that, when the access cover is opened, it can be pivoted through 180 degrees to lie flat on the floor or other support surface on which the container is placed. Retaining walls preferably are provided along opposite side edges of the access cover, such that the open cover forms a tray or receptacle which is open along the free edge of the open cover. Loose parts can thus easily be gathered by hand and swept up into the open sided receptacle at the end of a play session. The parts can then be discharged into the container by pivoting the cover upwardly over the access opening.

For a more complete understanding of the above and other features and advantages of the invention, reference should be made to the following detailed description of a preferred embodiment of the invention, and to the accompanying drawings.

DESCRIPTION OF PREFERRED EMBODIMENTS OF THE INVENTION

Figure 1:
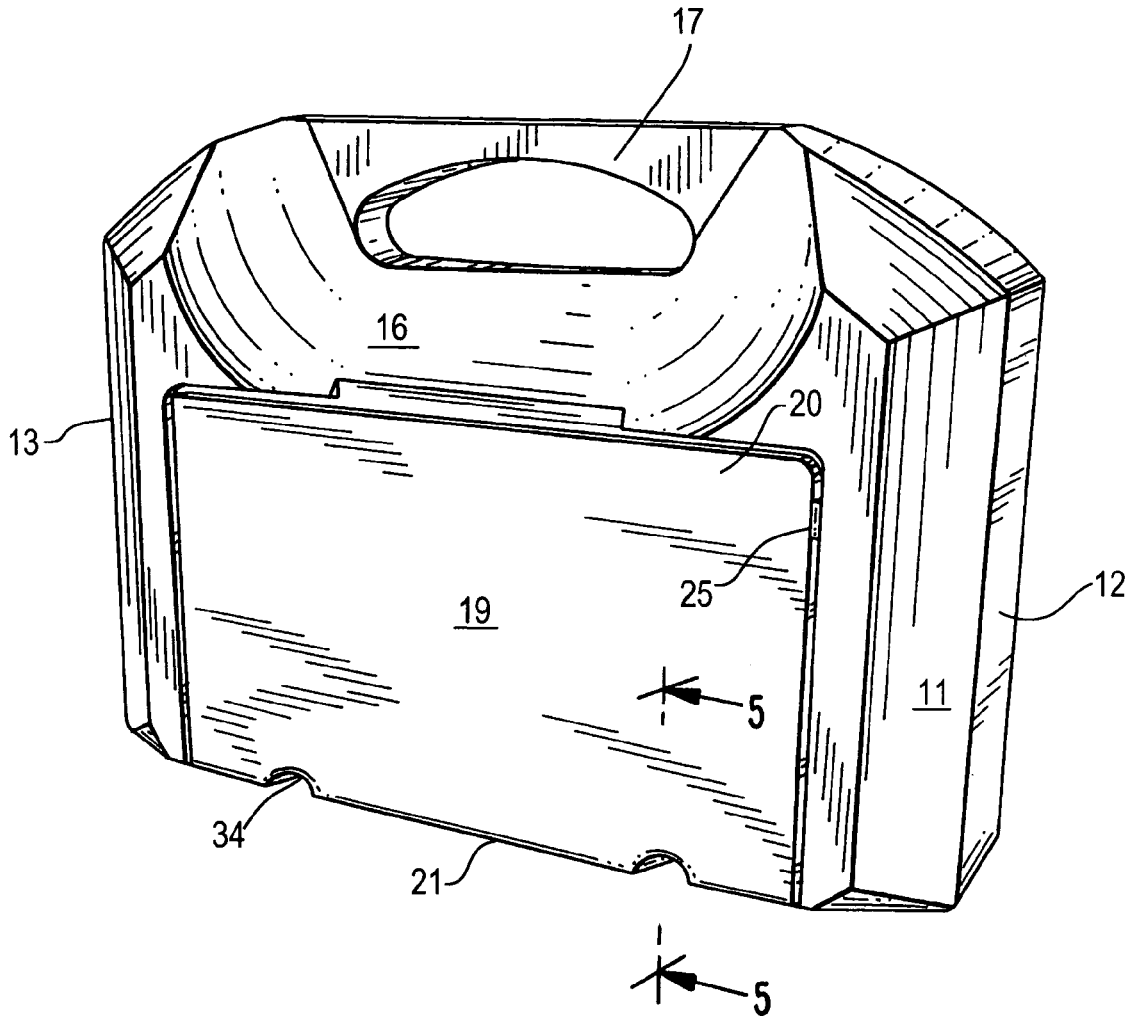
FIG. 1 is a perspective view of a container according to the invention for holding components of a construction toy set, illustrating the container standing in an upright orientation.

Referring now to the drawings, the reference numeral 10 designates generally a container for holding individual components of a toy construction set, such as the K'NEX construction toy. Such a construction set consists of a large number of relatively small parts, in the form of rods of various graduated lengths, small connectors engageable with the rods to form assemblies, and other miscellaneous parts such as wheels, gears, panels, etc. The container 10 is designed to contain the relevant parts during the initial shipments and customer sales, and thereafter to provide containment for loose parts between play sessions with the construction set. The size of the container 10 is, of course, a function of the number of parts supplied and will therefore vary with the cost and complexity of the construction set.

The illustrated container comprises a front wall 11 opposite side walls 12, 13, a bottom wall structure 14, a back wall 15 and a top structure 16 including a carrying handle 17. The entire container is preferably formed of a suitable plastic material and is formed with a hollow interior 18 of appropriate internal volume for the parts to be contained.

Figure 2:
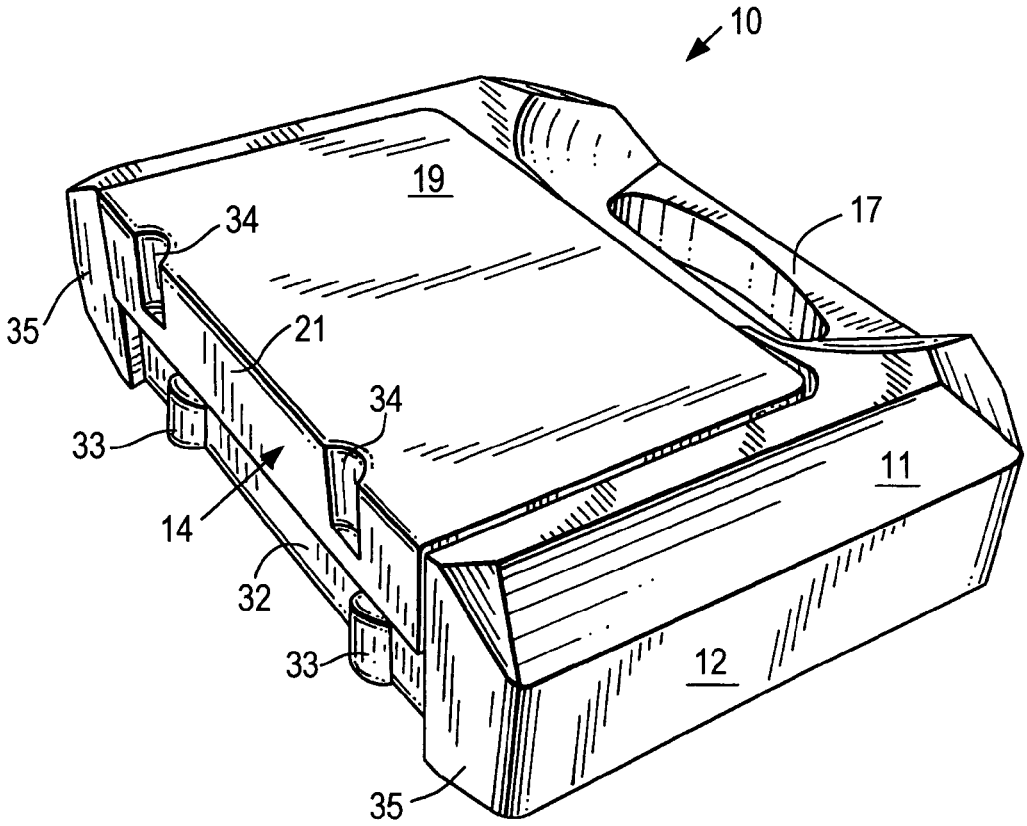
FIG. 2 is a perspective view of the container of FIG. 1, with the container shown in a horizontal orientation.
Figure 3:
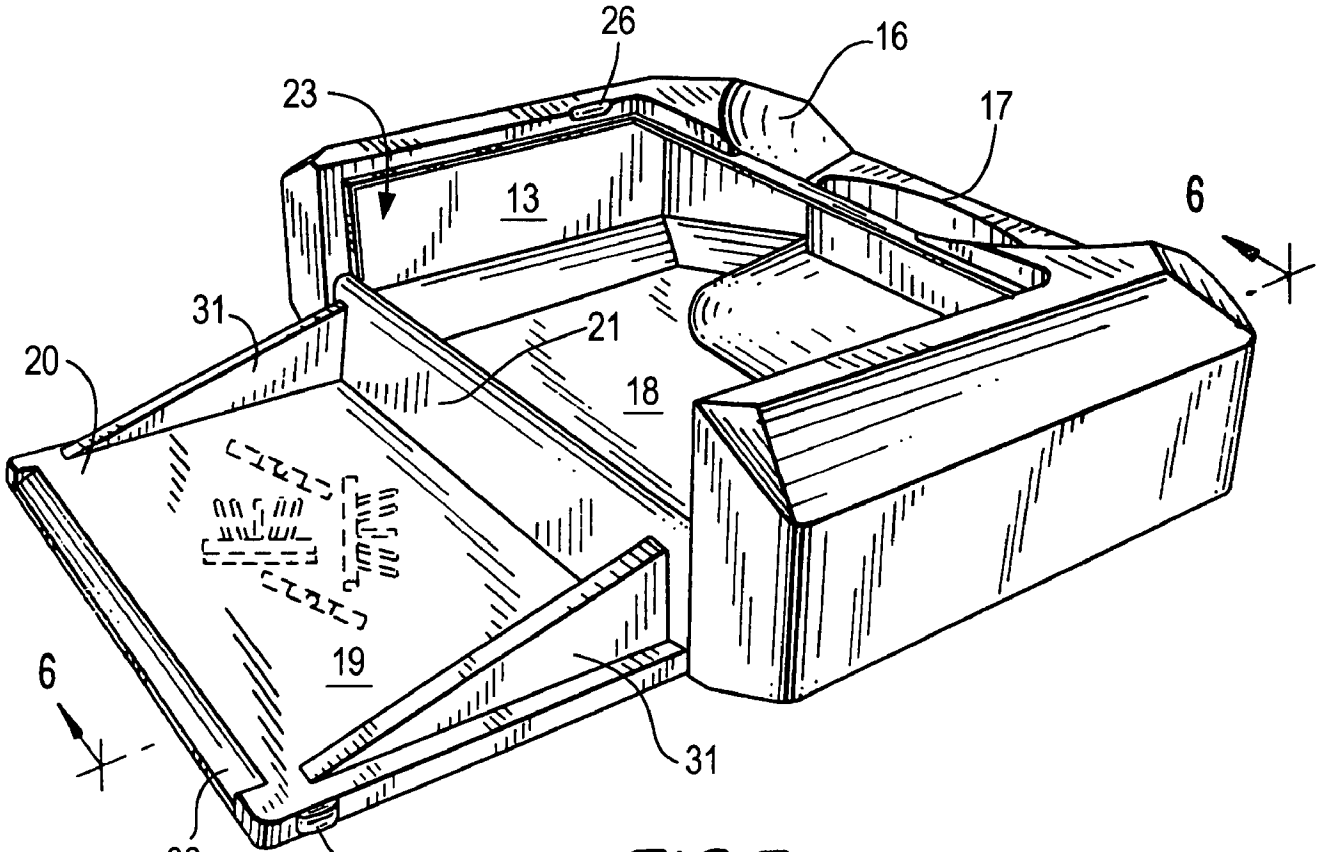
FIG. 3 is a perspective view, similar to FIG. 2, but showing the container with its access cover in an open position.
Figure 6:
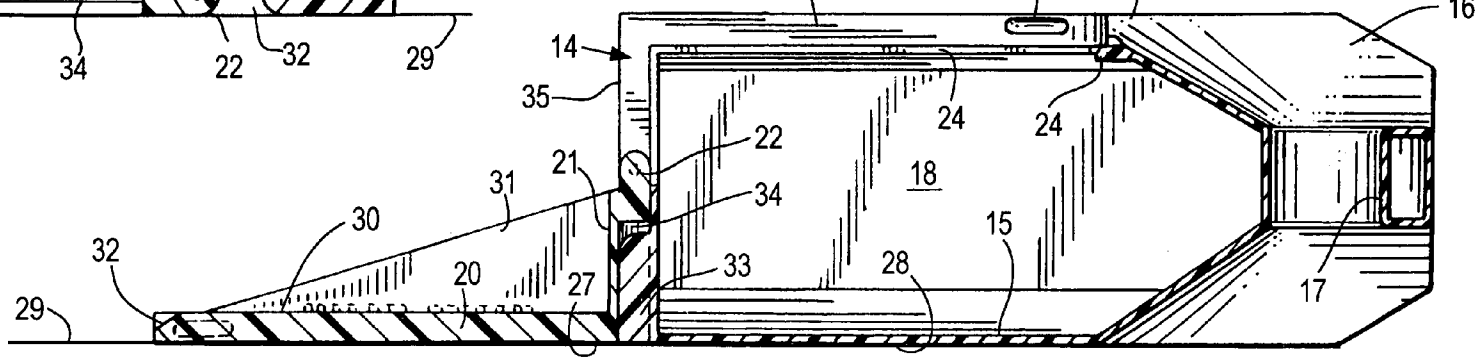
FIG. 6 is a cross sectional view as taken generally on line 6—6 of FIG. 3.

To advantage, the container 10 has a configuration similar to a thin suitcase or a briefcase, for example, for easy storage and carrying. The container is designed and intended to have two primary orientations, a vertical orientation as shown in FIG. 1, with the container supported by its bottom structure, and a horizontal orientation as shown in FIGS. 2 and 6, with the container being supported by its back wall 15.

In usage during a play session, it may be desired to simply dump the entire contents of the container 10 on to a floor, table or other support surface. In other cases, it may be preferred to leave some or all of the loose components in the container and extract them one at a time during the building process. Thus, known containers for this purpose provide an access cover, in the form of a large panel, forming a relatively large portion of the front wall of the container, and which is appropriately hinged to the front wall. Opening of this access cover provides a large opening for accessing the inside of the container for removal or return of parts.

In accordance with the present invention, a new and improved access cover arrangement is provided in which the access cover, designated generally by the reference numeral 19, is comprised of a first panel 20, constituting a large portion of the front wall 11, and a second panel 21 (FIGS. 5 and 6) comprising a portion of the bottom wall structure of the container. The first and second panels 20, 21 are disposed at right angles, and the entire access cover 19 is attached to the container by means of a hinge connection 22 located in the bottom wall structure, approximately midway between the front and back walls 11, 15 of the container. The geometry of the access cover 19 and its hinge arrangement 22 is such that, when the access cover 19 is pivoted to a closed position, shown in FIGS. 1, 2 and 5, both the bottom structure and the front wall structure are closed. When the access cover is pivoted to a fully open position, shown in FIG. 6, a large access opening 23 is provided in the front wall 11 and upper portions of the bottom wall structure 14 to provide easy access to the interior of the container.

Preferably, a narrow flange 24 is provided around the side and top edges of the access opening 23 to support peripheral edges of the access cover 19. Small detent elements 25 may be provided at the side edges of the access cover panel 19, to engage detent recesses 26 (FIG. 6) to releasably secure the cover in its closed position.

In accordance with a preferred embodiment of the invention, when the access cover 19 is pivoted to an open position, shown in FIG. 6, the bottom surface 27 of the cover panel 20 lies substantially in a common plane with the bottom surface 28 of the back wall 15, with the panel 20 projecting outwardly from the bottom wall structure 14 of the container. Thus, at the end of a play period, any loose parts lying on a support surface 29 can be swept by hand up on to the upper surface 30 of the cover panel 20. Advantageously, confining walls 31 extend along opposite side edges of the cover panels 20, 21 to help confine parts that are swept on to the surface 30. In the illustrated form of the invention, the confining panels 30 advantageously are of triangular shape, although other configurations are possible. Preferably, the free end 32 of the cover panel is tapered or beveled, to facilitate loose parts being swept from the surface 29 up on to the upper surface 30 of the cover panel. The open access panel forms a convenient tray or receptacle for receiving and retaining the loose parts.

Figure 4:
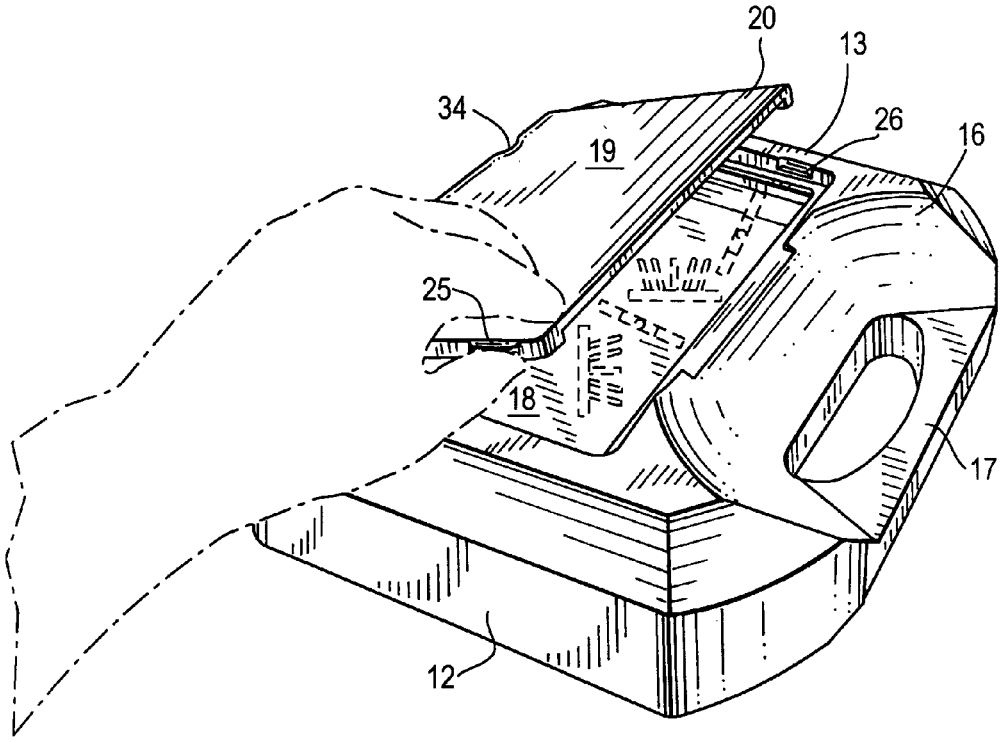
FIG. 4 is a perspective view showing the manner in which the access cover is utilized for discharging component parts into the container.

As will be understood, during a cleanup operation, a person may grip the container handle 17 with one hand and use the other hand to sweep parts into the open access cover, moving the entire container unit as necessary or convenient. When a sufficient number of parts have been swept on to the surface 30 of the tray, the cover 19 is pivoted upward, as reflected in FIG. 4, to discharge the accumulated parts into the interior of the container. If more cleanup is to be done, the access cover is simply returned to the position shown in FIG. 6 and the operation continued. Conveniently, the top structure 16 of the container is recessed in the area 36 immediately around the handle 17. This facilitates gripping of the handle when the container is in its horizontal orientation, and is particularly useful when the container is being moved about with the access cover open, for the collection of parts.

Figure 5:
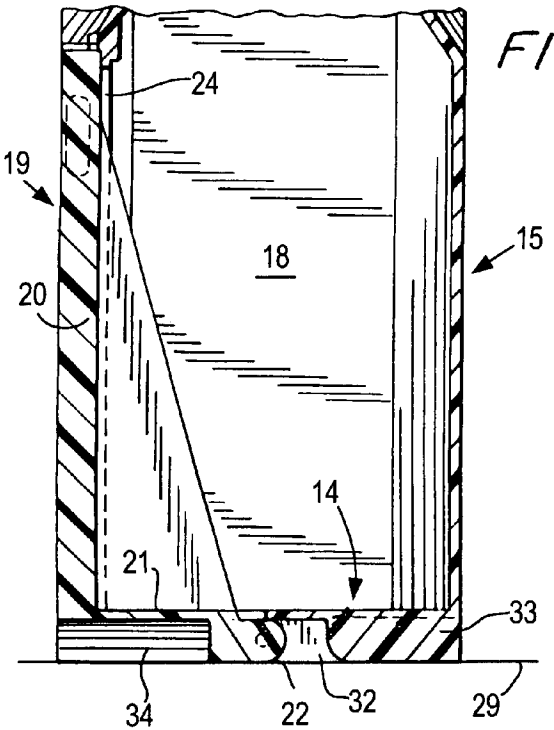
FIG. 5 is a fragmentary cross sectional view as taken generally on line 5—5 of FIG. 1.

In order to enable the access cover 19 to be pivoted a full 180 degrees to the position shown in FIG. 6, the bottom structure of the container must be recessed on the side opposite to the upper panel 21, as reflected at 32 in FIG. 5. At the same time, it is desired to provide stability to the container when oriented in its upright position. Accordingly, in the preferred embodiment of the invention, a pair of spaced-apart stabilizing lugs 33 are formed in the recessed portion 32 of the bottom structure and extend down to the support surface 29 as shown in FIG. 5. Thus, when the container is in its upright orientation, it is supported at both sides of the bottom structure—on the left side (as shown in FIG. 6) by the cover panel 21, and on the right side by the spaced-apart stabilizing lugs 33. Recesses 34, corresponding in size and shape to the stabilizing lugs 33, are formed in the bottom panel 21 of the access cover to receive the stabilizing lugs when the access cover is in its fully open position.

In the illustrated embodiment of the invention, the bottom structure 14 includes support portions 35 at each end which extend flush with the bottom surface extremities of the support lugs 33 and the cover panel 21, providing additional support for the container 10 in its upright orientation.

The new container of the invention retains all of the desirable and advantageous features of conventional containers for the same purpose, while adding significantly to the functionality of the container by providing an efficient cleanup facility. By configuring the access cover of the container to include not only a major portion of the front wall, but also a substantial portion of the bottom wall, the access cover opens to form a dust pan-like collection tray into which loose parts may be efficiently gathered by a sweeping motion of the hand. The handle of the container, which is opposite from the tray, allows the entire container and tray to be manipulated, to facilitate pickup of loose parts at the end of a play session. The parts are conveniently discharged into the container simply by an upward pivoting movement of the access cover, which causes all of the parts on the tray to slide into the open interior of the container.

Using of a portion of the bottom structure of the container to form the pickup tray makes for a highly efficient arrangement, allowing the tray to be easily moved from place to place and oriented toward the loose parts by manipulating the container handle 17. The container body may be tipped up slightly during this operation, if desired. The tray formed by the access cover 19 will remain flat on the support surface for convenient reception of loose parts.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A container for holding components of a construction toy or the like and for facilitating recovery of such components, which comprises (a) a container body comprised of spaced apart front and back walls, opposed side walls joining said front and back walls, a bottom structure having front and back portions for supporting said container in an upright orientation on a support surface, and a top structure including a carrying handle, (b) said container having a first primary orientation, in which said container is supported in an upright position by said bottom structure, and a second primary orientation, in which said container is supported in a horizontal position by its back wall on said support surface, (c) an access cover comprising a first portion formed of portions of said front wall and a second portion formed of front portions of said bottom structure, (d) a hinge structure connecting said second portion of said access cover to back portions of said bottom structure adjacent to said front portions thereof for pivoting movement about a hinge axis of said hinge structure, from a closed position, in which said access cover serves to close said container body, to an open position, in which portions of said front wall and portions of said bottom wall structure are open to provide access to interior portions of said container, (e) said access cover being adapted for a range of pivoting movement about said hinge axis such that, in the open position of said access cover, a free edge portion of said access cover, formed by a portion of said front wall, lies on said support surface, substantially in the plane of said back wall, to form a receiving surface for the reception of components of the construction toy or the like and to facilitate a sweeping movement of said components from said support surface onto the first portion of said access cover, and (f) one or more of projecting support elements forming part of said bottom structure and extending downward, below said hinge axis to provide stable support for said container in its said first primary orientation.

2. A container according to claim 1, wherein (a) said range of pivoting motion is at least 180°.

3. A container according to claim 1, wherein (a) the first portion of said access cover is disposed at a large angle to the second portion thereof, and (b) retaining walls extend along opposite side edges of said access cover, between said first and second portions thereof, to define an area for the temporary containment of components of said construction toy set.

4. A container according to claim 1, wherein (a) outer surface portions of the second portion of said access cover form a support for said container when said container is in an upright position on said support surface.

5. A container according to claim 4, wherein (a) the second portion of said access cover has a predetermined dimension in the front-to-back direction, (b) said bottom structure, in a region adjacent to and rearward of the second portion of said access cover, is recessed to accommodate the reception of said second portion when said access cover is pivoted about said hinge axis to an open position.

6. A container according to claim 5, wherein (a) said predetermined dimension is approximately one-half the front-to-back dimension of said container whereby, when said access cover is in an open position, the first portion of said access cover lies substantially in the same plane as the back wall of said container.

7. A container according to claim 4, wherein (a) said container has a greater width, between its opposite side walls, than a width of the second portion of said access cover, and (b) said support elements include downwardly projecting, fixed support portions adjacent opposite sides of said second portion and serving with said outer surface portions to support said container in its upright position on said support surface.

8. A container according to claim 1, wherein (a) an upper edge portion of said access cover is of tapered cross section to facilitate sliding movement of construction toy components from said support surface onto said receiving surface.

9. A container according to claim 1, wherein (a) the top structure of said container, in regions immediately adjacent to said carrying handle, is recessed in relation to said back wall to accommodate engagement and gripping of said carrying handle when said container is supported in its horizontal position on said support surface.

10. A container for holding components of a construction toy or the like and for facilitating recovery of such components, which comprises (a) a container body comprised of spaced apart front and back walls, opposed side walls joining said front and back walls, a bottom structure having front and back portions for supporting said container in an upright orientation on a support surface, and a top structure including a carrying handle, (b) said container having a first primary orientation, in which said container is supported in an upright position by said bottom structure, and a second primary orientation, in which said container is supported in a horizontal position by its back wall on said support surface, (c) an access cover comprising a first portion formed of portions of said front wall and a second portion formed of front portions of said bottom structure, (d) a hinge structure connecting said second portion of said access cover to back portions of said bottom structure adjacent to said front portions thereof for pivoting movement about a hinge axis of said hinge structure, from a closed position, in which said access cover serves to close said container body, to an open position, in which portions of said front wall and portions of said bottom wall structure are open to provide access to interior portions of said container, (e) said access cover being adapted for a range of pivoting movement about said hinge axis such that, in the open position of said access cover, a free edge portion of said access cover, formed by a portion of said front wall, lies on said support surface, substantially in the plane of said back wall to form a receiving surface for the reception of components of the construction toy or the like and to facilitate a sweeping movement of said components from said support surface onto the first portion of said access cover, (f) outer surface portions of the second portion of said access cover forming a support for said container when said container is in an upright position, (g) the second portion of said access cover having a predetermined dimension in the front-to-back direction, (h) said bottom structure, in a region adjacent to and rearward of the second portion of said access cover, being recessed to accommodate the reception of said second portion when said access cover is pivoted about said hinge axis to an open position, (i) the recessed region of said bottom structure being formed with at least one downward projection, extending below said hinge axis and providing stable support for said container in its upright position, and (j) said second portion of said access cover being formed with at least one recess therein for the reception of said at least one downward projection, when said access cover is in an open position.

* * * * *